United States Patent [19]

Harvey

[11] 4,411,748

[45] Oct. 25, 1983

[54] ANODE AND PROCESS FOR MAGNESIUM PRODUCTION

[75] Inventor: Jay A. Harvey, Calcutta, India

[73] Assignee: Great Lakes Carbon Corporation, New York, N.Y.

[21] Appl. No.: 303,635

[22] Filed: Sep. 18, 1981

[51] Int. Cl.[3] ..... C25C 3/04; C25C 7/02

[52] U.S. Cl. ..... 204/70; 204/290 R

[58] Field of Search ..... 204/70, 290 R

[56] References Cited

U.S. PATENT DOCUMENTS 3,348,929 10/1967 Valtschev et al. ..... 29/180
3,476,586 11/1969 Valtschev et al. ..... 117/71
3,921,023 11/1975 Valtschev et al. ..... 313/357

FOREIGN PATENT DOCUMENTS 56-51587 5/1981 Japan .
351503 6/1931 United Kingdom ..... 204/70
467440 6/1937 United Kingdom ..... 204/70
561651 5/1944 United Kingdom ..... 204/70

*Primary Examiner*—Howard S. Williams
*Attorney, Agent, or Firm*—R. Laddie Taylor

[57] ABSTRACT

An anode for use in the electrolytic production of magnesium comprises a graphite body having an essentially impermeable coating thereon of magnesium or magnesium-aluminum alloy.

9 Claims, No Drawings

ANODE AND PROCESS FOR MAGNESIUM PRODUCTION

BACKGROUND OF THE INVENTION

Magnesium is conventionally produced by electrolysis of magnesium chloride by the reation $$MgCl_2 \rightarrow Mg + Cl_2.$$

In the Dow process, for example, the electrolysis cell is constructed of steel with the cathodes welded to the tublike container that holds the bath. The cell is fitted with a refractory cover through which multiple cylindrical graphite anodes pass. The anodes are suspended such that they can be adjusted independently to maintain the proper spacing and centering with respect to the respective cathodes as the anodes are consumed.

The cell operates at temperatures of about 700°–720° C. at a pressure slightly below atmospheric pressure in order to facilitate collection of chlorine gas, which is a by-product of the electrolysis. The graphite anodes used in the cell, which are consumed by oxidation due to the presence of impurity water in the bath, are fed into the cell through relatively air tight seals at the top of the cell. Because of the low pressure in the cell, air is drawn through the porosity of the graphite anodes and oxidizes the graphite in the region thereof below the top of the cell and above the surface of the molten electrolyte. Graphite is consumed at approximately 100 g/kg magnesium product.

SUMMARY OF THE INVENTION

The primary objective of the invention is to provide a graphite anode for the electrolytic production of magnesium which is not substantially subjected to oxidation due to air which is drawn into the electrolytic cell through the porosity inherent in the graphite.

Another objective of this invention is to provide a method for the production of magnesium wherein anode consumption is reduced.

These and other objectives are achieved by providing an anode for the electrolytic production of magnesium which comprises a graphite body having an essentially impermeable coating thereon selected from the group consisting of magnesium and magnesium-aluminum alloy. The coating prevents the entry of air into the graphite porosity because of the reduced pressure in the cell and thus substantially reduces the resultant oxidation of the anode. The temperature above the cell top is not sufficient to melt the metal coating, thus the coating will remain intact until it reaches the region below the air seal and melts, falls into the electrolyte bath, and is drawn off along with the electrolysis product.

A method for the production of magnesium in an electrolytic cell having at least one anode and an essentially air tight seal through which the anode passes is also provided, wherein the anode comprises a graphite body having an essentially impermeable coating thereon at least in the region above the seal, the coating being selected from the group consisting of magnesium and magnesium-aluminum alloy.

In the case where the coating is an alloy, it preferably consists of about 60 to 95 wt. % magnesium and about 40 to 5 wt. % aluminum.

DESCRIPTION OF THE PREFERRED EMBODIMENTS

The following examples will further describe the invention. It is understood that the examples are provided to illustrate the practice of the invention, and are not intended as limiting beyond the limitations imposed by the appended claims.

EXAMPLE I

A graphite anode, machined to proper diameter to pass through an air tight seal of a magnesium production cell after coating, is placed on a lathe-type machine equipped with jigs designed to protect the socketed ends of the anode. The machine is also equipped with flame spraying equipment designed to spray a uniform coating. The machine and spraying equipment are activated and a uniform coating of about 2 mm thickness consisting of an alloy of about 80 wt. % magnesium and about 20 wt. % aluminum is sprayed on the anode. The coated anode may then be used in an electrolytic cell for the production of magnesium in the manner known in the art.

EXAMPLE II

An ordinary graphite anode is added to an electrolytic cell for the production of magnesium in a conventional manner. The surface of the anode above the essentially air tight seal is then uniformly flame-sprayed to a thickness of about 2 mm with an alloy consisting of about 80 wt. % magnesium and about 20 wt. % aluminum to form an essentially impermeable coating which reduces the amount of air drawn into the cell through the porous structure of the anode during operation thereof. Reducing this air flow reduces the loss of graphite due to oxidation and improves the electrical efficiency of the cell by reducing the "scalloped" shape of the anode which oxidation causes and which in turn adds variability to the anode/cathode distance.

While the invention has been described in detail and with reference to specific embodiments thereof, it will be apparent to one skilled in the art that various changes and modifications can be made therein without departing from the scope and spirit thereof, and, therefore, the invention is not intended to be limited except as indicated in the appended claims.

What is claimed is:

1. An anode for the electrolytic production of magnesium by the Dow process comprising a graphite body having an essentially impermeable coating thereon selected from the group consisting of magnesium and magnesium-aluminum alloy.

2. The anode of claim 1 wherein the coating consists of about 100% magnesium.

3. The anode of claim 1 wherein the coating consists of an alloy consisting of about 60 to 95 wt. % magnesium and about 40 to 5 wt. % aluminum.

4. The anode of claim 1 wherein the coating consists of an alloy consisting of about 80 wt. % magnesium and about 20 wt. % aluminum.

5. A method for the production of magnesium by the Dow process in an electrolytic cell having at least one anode and an essentially air tight seal through which said anode passes, wherein said anode comprises a graphite body having an essentially impermeable coating thereon at least in the region above said seal, said coating being selected from the group consisting of magnesium and magnesium-aluminum alloy.

6. The method of claim 5 wherein the coating for the graphite body consists of about 100% magnesium.

7. The method of claim 5 wherein the coating for the graphite body consists of an alloy consisting of abouut 60 to 95 wt. % magnesium and about 40 to 50 wt. % aluminum.

8. The method of claim 5 wherein the coating for the graphite body consists of an alloy consisting of about 80 wt. % magnesium and about 20 wt. % aluminum.

9. The method of claim 5 wherein the coating substantially completely covers the graphite body.

* * * * *